US012584419B1

(12) United States Patent
Clark et al.

(10) Patent No.: US 12,584,419 B1
(45) Date of Patent: Mar. 24, 2026

(54) OPEN ROTOR GAS TURBINE ENGINE WITH ADAPTIVE TURBINE CLEARANCE CONTROL SYSTEM AND METHOD

(71) Applicant: RTX Corporation, Farmington, CT (US)

(72) Inventors: Thomas E. Clark, Wells, ME (US); Murat Yazici, Glastonbury, CT (US)

(73) Assignee: RTX Corporation, Farmington, CT (US)

( * ) Notice: Subject to any disclaimer, the term of this patent is extended or adjusted under 35 U.S.C. 154(b) by 0 days.

(21) Appl. No.: 18/966,925

(22) Filed: Dec. 3, 2024

(51) Int. Cl.
*F01D 11/24* (2006.01)
*F01D 11/14* (2006.01)
*F01D 11/20* (2006.01)

(52) U.S. Cl.
CPC ..... *F01D 11/24* (2013.01); *F01D 11/14* (2013.01); *F01D 11/20* (2013.01)

(58) Field of Classification Search
CPC ..... F01D 11/24; F01D 11/20; F01D 11/14; F01D 11/16; F01D 11/18; F01D 11/22
See application file for complete search history.

(56) References Cited

U.S. PATENT DOCUMENTS

| | | | | |
|---|---|---|---|---|
| 7,740,443 | B2 | 6/2010 | Seitzer | |
| 7,823,389 | B2 | 11/2010 | Seitzer | |
| 9,222,411 | B2 | 12/2015 | Sennoun | |
| 11,215,197 | B2 | 1/2022 | Suciu | |
| 2008/0112798 | A1* | 5/2008 | Seitzer | F01D 11/24 60/262 |
| 2008/0115503 | A1 | 5/2008 | Vasquez | |
| 2013/0164115 | A1* | 6/2013 | Sennoun | F01D 25/12 415/1 |
| 2014/0072399 | A1* | 3/2014 | Maldonado | F02C 7/12 415/1 |
| 2016/0003086 | A1* | 1/2016 | Day | F01D 11/24 415/136 |
| 2019/0360400 | A1* | 11/2019 | Elliott | F02C 7/04 |
| 2024/0352866 | A1* | 10/2024 | Vondrell | F01D 11/20 |

FOREIGN PATENT DOCUMENTS

KR 20200137697 A * 12/2020 ..... F02C 9/18

OTHER PUBLICATIONS

English translation of KR20200137697 (Year: 2020).*

* cited by examiner

*Primary Examiner* — Thomas P Burke
(74) *Attorney, Agent, or Firm* — Getz Balich LLC

(57) ABSTRACT

A gas turbine engine disposed within a nacelle is provided that includes an open rotor propulsion system, compressor, combustion, and turbine sections, a lubrication system, and a turbine active clearance control system. The turbine active clearance control system includes first and second valves, a heat exchanger, and a nacelle air inlet device. The heat exchanger receives air from the air inlet device, accepts a lubricant flow therethrough, and permits heat transfer between the air flow and the lubricant to produce a conditioned air flow. The first valve receives conditioned air flow from the heat exchanger and may pass the conditioned air flow to the second valve. The second valve receives a second air flow from the air inlet device. The turbine active clearance control system may operate in a heating mode in which conditioned air flow, or a combined air flow is provided to the turbine case clearance control segment.

15 Claims, 5 Drawing Sheets

OPEN ROTOR GAS TURBINE ENGINE WITH ADAPTIVE TURBINE CLEARANCE CONTROL SYSTEM AND METHOD

BACKGROUND OF THE INVENTION

1. Technical Field

The present disclosure relates gas turbine engines in general and to turbine clearance control systems and methods in particular.

2. Background Information

Aircraft gas turbine engines are often configured to have a turbine rotor blade tip clearance that accounts for a maximum amount of centrifugal radial rotor blade growth, a maximum amount of rotor stage thermal growth, and a thermal disparity between the rotor stage and the turbine case structure radially outside of the rotor stage. Basing the rotor tip clearance on maximum values can facilitate avoiding a pinch condition between the rotor blade tips and the turbine case structure. Engine efficiency is, however, affected by blade tip clearance. It would be useful to provide a system and method for actively controlling turbine rotor blade tip clearance.

SUMMARY

According to an aspect of the present disclosure, a gas turbine engine disposed within a nacelle is provided that includes an open rotor propulsion system, a compressor section, a combustion section, a turbine section, a lubrication system, and a turbine active clearance control system. The turbine section has a rotor stage and a turbine case clearance control segment disposed radially outside of the rotor stage. The lubrication system is configured to cycle a lubricant flow. The turbine active clearance control system includes a first valve, a heat exchanger, a second valve, and an air inlet device in fluid communication with an exterior wall of the nacelle. The heat exchanger is in fluid communication with the air inlet device to receive a first exterior air flow from the air inlet device, and is configured to permit the lubricant flow to pass through the heat exchanger, and is configured to permit heat transfer between the first exterior air flow and the lubricant flow within the heat exchanger to produce a flow of conditioned air. The first valve is in fluid communication with the heat exchanger to receive the flow of conditioned air, and is configured to permit passage of the flow of conditioned air to the second valve. The second valve is configured to receive the flow of conditioned air from the first valve, and is configured to receive a second exterior air flow from the air inlet device. The turbine active clearance control system is configured to operate in a heating mode, and in the heating mode the second valve is configured to provide the flow of conditioned air, or a combined air flow that includes the flow of conditioned air and the second exterior air flow, to the turbine case clearance control segment.

In any of the aspects or embodiments described above and herein, in the heating mode the first valve may be controllable to provide at least a portion of the flow of conditioned air received from the heat exchanger to the second valve.

In any of the aspects or embodiments described above and herein, in the heating mode the second valve may be controllable to provide all the flow of conditioned air received from the first valve to the turbine case clearance control segment.

In any of the aspects or embodiments described above and herein, in the heating mode the second valve may be controllable to provide less than all the flow of conditioned air received from the first valve to the turbine case clearance control segment.

In any of the aspects or embodiments described above and herein, in the heating mode the second valve may be controllable to provide at least a portion of the flow of conditioned air received from the first valve to the turbine case clearance control segment and at least a portion of the second exterior air flow received from the air inlet device to the turbine case clearance control segment.

In any of the aspects or embodiments described above and herein, the turbine section may include a high pressure turbine section and the turbine case clearance control segment may include a first turbine case clearance control segment disposed radially outside of a high pressure rotor stage within the high pressure turbine section.

In any of the aspects or embodiments described above and herein, the turbine section may include a low pressure turbine section and the turbine case clearance control segment may include a second turbine case clearance control segment disposed radially outside of a low pressure rotor stage within the low pressure turbine section.

In any of the aspects or embodiments described above and herein, the turbine active clearance control system may be configured to operate in a cooling mode. In the cooling mode the second valve may be configured to provide at least a portion of the second exterior air flow to the turbine case clearance control segment.

In any of the aspects or embodiments described above and herein, the first valve may be in fluid communication with an exterior of the nacelle. In the cooling mode, the first valve may be configured to provide at least a portion of the flow of conditioned air to the exterior of the nacelle.

According to an aspect of the present disclosure, a gas turbine engine is provided that includes an open rotor propulsion system, a compressor section, a combustion section, a turbine section, and a turbine active clearance control system. The turbine section has a rotor stage and a turbine case clearance control segment disposed radially outside of the rotor stage. The turbine active clearance control system includes a first valve, a heat exchanger, a second valve, and an air inlet device in fluid communication with an exterior wall of the nacelle. The first valve is in fluid communication with the air inlet device to an exterior air flow from the air inlet device, and is configured to provide the exterior air flow to the heat exchanger, or to the second valve, or to both. The heat exchanger is configured to permit heat transfer within the heat exchanger between the exterior air flow provided to the heat exchanger and a compressor bleed flow from the compressor section provided to the heat exchanger to produce a flow of conditioned air. The second valve is configured to receive the exterior air flow from the first valve and to receive the flow of conditioned air from the heat exchanger. The turbine active clearance control system is configured to operate in a heating mode. In the heating mode, the second valve is configured to provide the flow of conditioned air, or a combined air flow that includes the flow of conditioned air and the exterior air flow, to the turbine case clearance control segment.

In any of the aspects or embodiments described above and herein, in the heating mode the first valve is controllable to selectively vary relative amounts of the exterior air flow provided to the heat exchanger and the exterior air flow provided to the second valve.

In any of the aspects or embodiments described above and herein, in the heating mode the second valve may be controllable to selectively vary relative amounts of the flow of conditioned air and the exterior air flow provided to the turbine case clearance control segment.

In any of the aspects or embodiments described above and herein, the turbine active clearance control system may be configured to operate in a cooling mode, and in the cooling mode the first valve may be configured to provide at least a portion of the exterior air flow to the second valve.

In any of the aspects or embodiments described above and herein, in the cooling mode the second valve may be configured to provide at least a portion of the exterior air flow to the turbine case clearance control segment.

According to an aspect of the present disclosure, a method of actively controlling rotor tip clearance in a gas turbine engine disposed in a nacelle is provided. The gas turbine engine includes an open rotor propulsion system, a compressor section, a combustion section, a turbine section having a rotor stage, and a turbine case clearance control segment disposed radially outside of the plurality of the rotor stage. The method includes: providing a turbine active clearance control system that includes a first valve, a heat exchanger, and a second valve; using the first valve to receive an exterior air flow extracted from an exterior of the nacelle, and to provide the exterior air flow to a heat exchanger, or to the second valve, or to both, wherein the heat exchanger is configured to permit heat transfer within the heat exchanger between the exterior air flow provided to the heat exchanger and a compressor bleed flow extracted from the compressor section and provided to the heat exchanger to produce a flow of conditioned air; using the second valve to receive the exterior air flow from the first valve and to receive the flow of conditioned air from the heat exchanger; and operating the turbine active clearance control system in a heating mode or in a cooling mode, wherein the heating mode includes controlling the second valve to provide the flow of conditioned air, or a combined air flow that includes the flow of conditioned air and the exterior air flow from the first valve, to the turbine case clearance control segment.

In any of the aspects or embodiments described above and herein, in the heating mode the method may include controlling the first valve to vary relative amounts of the exterior air flow provided to the heat exchanger and the exterior air flow provided to the second valve.

In any of the aspects or embodiments described above and herein, in the heating mode the method may include controlling the second valve to vary relative amounts of the flow of conditioned air and the exterior air flow from the first valve provided to the turbine case clearance control segment.

In any of the aspects or embodiments described above and herein, in the cooling mode the method may include controlling the first valve to vary relative amounts of the exterior air flow provided to the heat exchanger and the exterior air flow provided to the second valve, and may include controlling the second valve to vary relative amounts of the flow of conditioned air and the exterior air flow from the first valve provided to the turbine case clearance control segment.

The foregoing features and elements may be combined in various combinations without exclusivity, unless expressly indicated otherwise. For example, aspects and/or embodiments of the present disclosure may include any one or more of the individual features or elements disclosed above and/or below alone or in any combination thereof. These features and elements as well as the operation thereof will become more apparent in light of the following description and the accompanying drawings. It should be understood, however, the following description and drawings are intended to be exemplary in nature and non-limiting.

DETAILED DESCRIPTION

Figure 1:
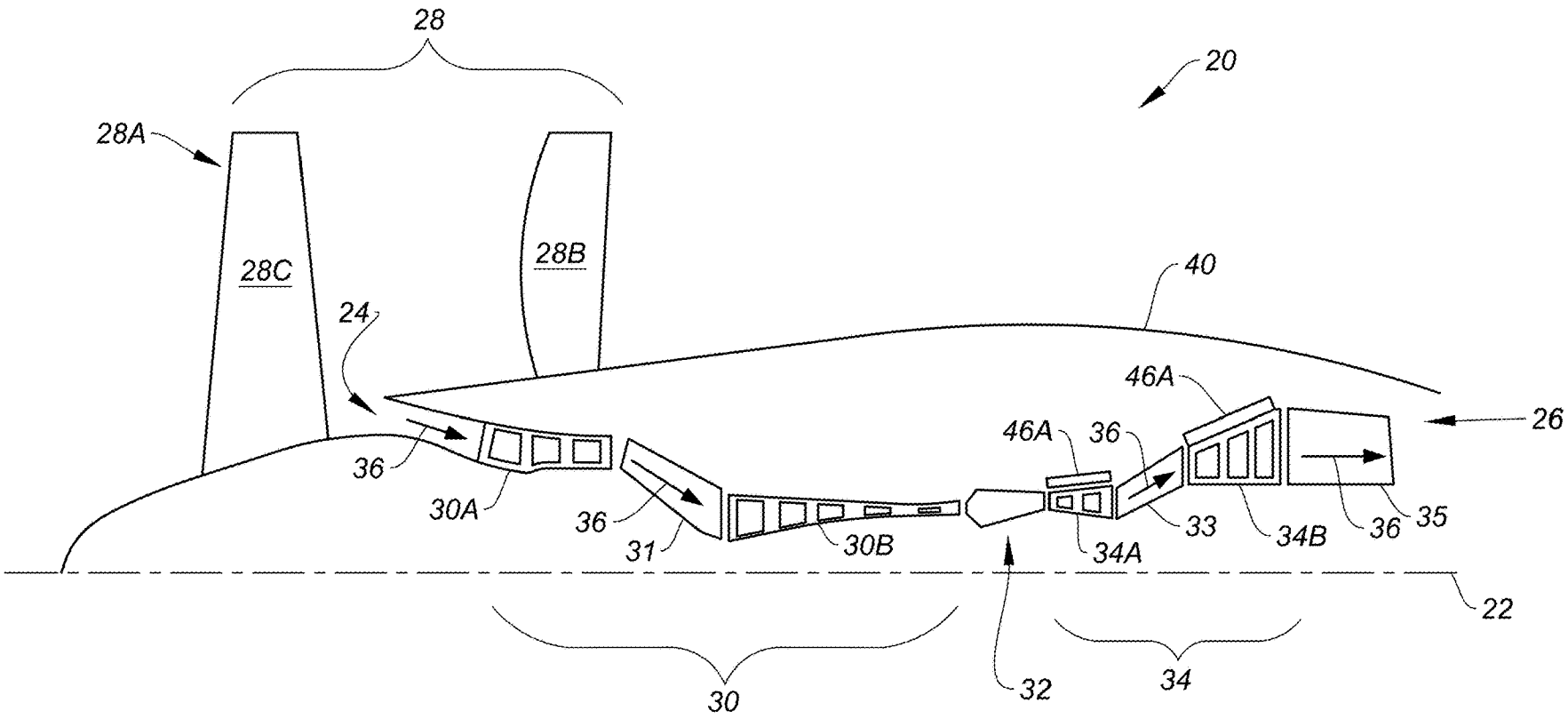
FIG. 1 is a diagrammatic sectional view of a gas turbine engine embodiment.

FIG. 1 shows a diagrammatic view of a gas turbine engine 20 in an open rotor configuration. The gas turbine engine 20 extends along an axial centerline 22. The gas turbine engine 20 includes an upstream airflow inlet 24, a downstream exhaust 26, an open rotor propulsion system 28, a compressor section 30, a combustion section 32, and a turbine section 34. The open rotor propulsion ("ORP") system 28 includes an ORP rotor 28A and a plurality of stator vanes 28B (sometimes referred to as "swirl recovery vanes" or "SRVs") that are disposed aft of the ORP rotor 28A. The ORP rotor 28A includes a plurality of ORP blades 28C. The compressor section 30 includes a low-pressure compressor (LPC 30A) and a high-pressure compressor (HPC 30B). The turbine section 34 includes a high-pressure turbine (HPT 34A) and a low-pressure turbine (LPT 34B). The engine 20 sections are arranged sequentially along the centerline 22 within an engine housing. The LPC 30A is connected to and driven by the LPT 34B through a low-speed shaft (not shown). The HPC 30B is connected to and driven by the HPT 34A through a high-speed shaft (not shown). The ORP rotor 28A may be driven by the low-speed shaft (not shown); e.g., indirectly with a reduction gear box in drive communication with both the low-speed shaft and the ORP rotor 28A. The present disclosure is not limited to any particular ORP system 28 configuration.

Air enters the core gas path 36 of the gas turbine engine 20 through an airflow inlet 24 disposed aft of the ORP rotor 28A. The core gas path 36 extends through the LPC 30A, the intermediate case 31, the HPC 30B, the combustion section 32, the HPT 34A, the mid-turbine frame 33, the LPT 34B, and the turbine exhaust case 35. Core gas exiting the LPT 34B exits the engine 20 via the exhaust 26. The gas turbine engine 20 is diagrammatically shown in FIG. 1 disposed within a nacelle structure 40.

The gas turbine engine 20 configuration diagrammatically shown in FIG. 1 is an example provided to facilitate the description herein. The present disclosure may be implemented in a variety of different gas turbine engine configurations and is not therefore limited to the gas turbine engine 20 configuration diagrammatically shown in FIG. 1.

The terms "forward", "leading", "aft, "trailing" are used herein to indicate the relative position of a component or surface. As air passes through the engine 20, a leading edge of a stator vane or rotor blade encounters the air before the trailing edge of the same. In a conventional axial engine such as that shown in FIG. 1, the compressor section 30 is forward of the turbine section 34 and the turbine section 34 is aft of the compressor section 30. The terms "inner radial" and "outer radial" refer to relative radial positions from the engine centerline 22. An inner radial component or path is disposed radially closer to the engine centerline 22 than an outer radial component or path.

Figure 2:
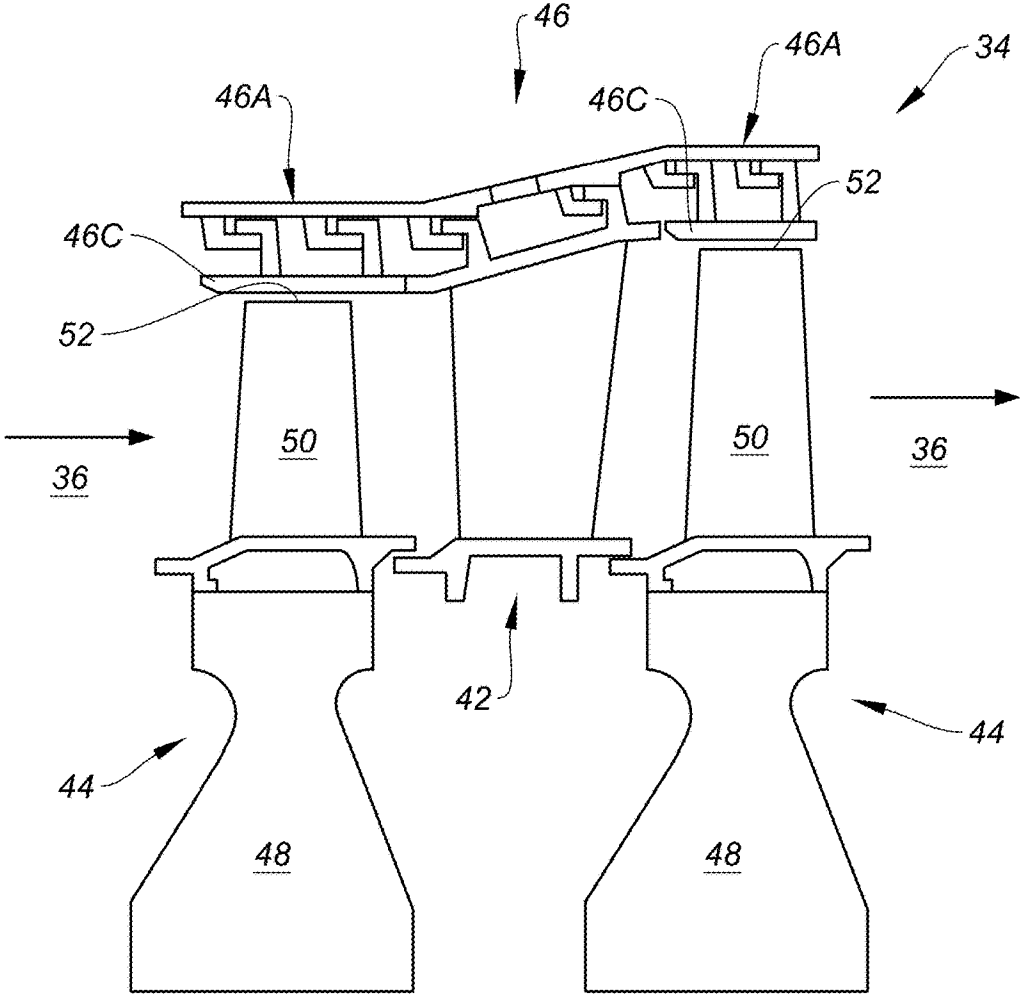
FIG. 2 is a diagrammatic partial illustration of a turbine section embodiment.

FIG. 2 diagrammatically illustrates a portion of a turbine section 34 including a stator vane stage 42 disposed between a pair of rotor stages 44. A turbine case 46 is disposed radially outside of the stator vane stage 42 and the rotor stages 44. Each rotor stage 44 includes a disk 48 rotatable about the axial engine centerline 22, with a plurality of rotor blades 50 that extend radially out from the disk 48 and into the core gas path 36. Each rotor blade 50 includes a blade tip 52 at the outer radial end of an airfoil portion of the rotor blade 50. The arrows shown in FIG. 2 illustrate the direction of core gas passing through the turbine section 34 along the core gas path 36. To facilitate the description herein, the portion of the turbine case 46 and related components disposed radially outside of a turbine rotor stage 44 will be referred to as a "turbine case clearance control segment 46A". The turbine case clearance control segment 46A includes a blade outer air seal 46C disposed immediately radially outside of each rotor stage 44. The turbine section 34 shown in FIG. 2 is provided herewith to diagrammatically illustrate an arrangement of rotor stages and stator vane stages within a turbine section 34 and turbine case clearance control segment 46A disposed radially outside of the turbine rotor stages 44. The present disclosure is not limited to any turbine section 34 configuration other than as described herein.

Figure 3:
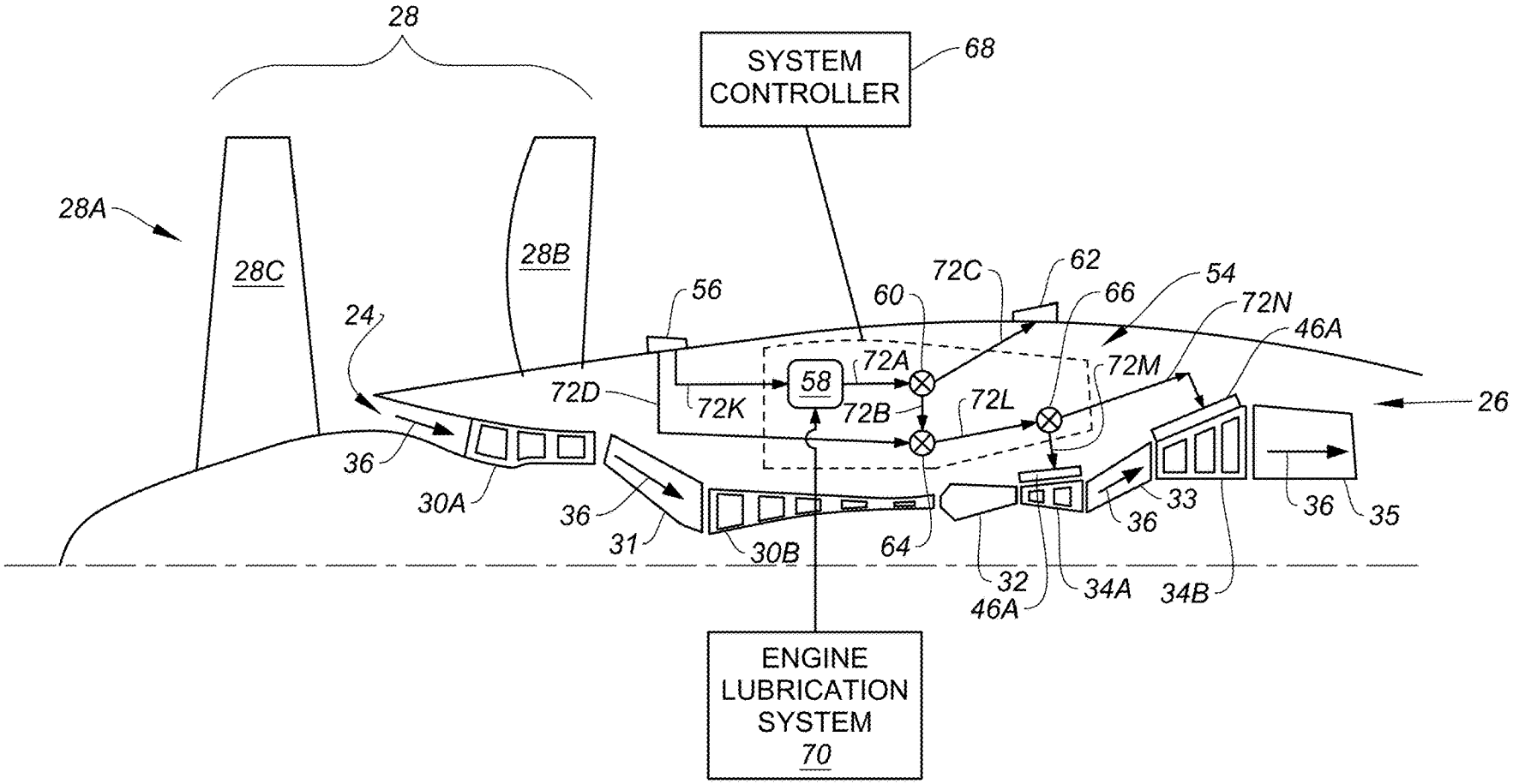
FIG. 3 is a diagrammatic sectional view of a gas turbine engine according to an embodiment of the present disclosure.

FIG. 3 diagrammatically illustrates an embodiment of a turbine active clearance control (ACC) system 54 that may be used in the present disclosure. The turbine ACC system 54 includes an inlet device 56, a heat exchanger 58, a first valve 60, an exterior air return 62, and a second valve 64. In some embodiments (e.g., as shown in FIG. 3), the turbine ACC system 54 may include a third valve 66. As will be described herein, air conduits 72A, 72B, 72C, 72D, 72K, 72L, 72M, 72N (e.g., air passages formed by interior structural panels, or tubes, or the like, or any combination thereof) provide fluid communication between the turbine ACC system 54 components. In some embodiments, additional fluid flow components (e.g., valves, filters, and the like) may be included. In some embodiments, the turbine ACC system 54 may include or be in communication with a system controller 68 for control of turbine ACC system 54 components.

The inlet device 56 is engaged with the nacelle structure 40 and is configured to extract exterior air from the exterior of the nacelle 40 and pass the extracted exterior air to components within the turbine ACC system 54 through conduits 72D, 72K as will be detailed herein. In some embodiments, the inlet device 56 may include an orifice (not shown) disposed in the exterior wall of the nacelle structure 40. In some embodiments, the inlet device 56 may include a scoop or other structure that is engaged with the exterior wall of the nacelle structure 40; e.g., a scoop oriented to collect air disposed outside of the nacelle 40. The present disclosure is not limited to any particular inlet device 56 configuration.

The heat exchanger 58 may be a two-fluid heat exchanger 58 that is configured to receive an exterior air flow extracted from the exterior of the nacelle 40 via the inlet device 56 and configured to receive engine lubricant from the lubrication system 70 of the gas turbine engine 20. Exterior air from the inlet device 56 passes to the heat exchanger 58 via conduit 72K. The heat exchanger 58 is configured to allow thermal energy to transfer from one fluid (e.g., the engine lubricant) to a second fluid (e.g., exterior air passing through the heat exchanger 58). The heat exchanger 58 is not limited to any particular configuration other than the two fluids are maintained separate from one another; i.e., no direct contact or mixing between the fluids. A crossflow heat exchanger is a non-limiting example of an acceptable configuration for the heat exchanger 58. The exterior air flow exiting the heat exchanger 58 (referred to hereinafter as "conditioned air") is directed to the first valve 60 through a conduit 72A.

In addition to being in fluid communication with the heat exchanger 58 via conduit 72A, the first valve 60 is in fluid communication with the second valve 64 via conduit 72B and the exterior air return 62 via conduit 72C. The first valve 60 is controllable to be in an open configuration or in a closed configuration. When in the open configuration, the first valve 60 may be controlled to direct the conditioned air exiting the heat exchanger 58 (via conduit 72A) to the second valve 64 (via conduit 72B) and/or to the exterior air return 62 via conduit 72C. The first valve 60 may be controlled to provide all the conditioned air to the second valve 64 or all the conditioned air to the exterior air return 62; e.g., in a fully open configuration. In some embodiments, the first valve 60 may be controlled to provide less than all the conditioned air to the second valve 64 or less than all the conditioned air to the exterior air return 62; e.g., a partially open configuration. In some embodiments, the first valve 60 may be configured to provide conditioned air to both the second valve 64 and the exterior air return 62; i.e., the first valve 60 may be configured to provide a first portion of the conditioned air to the second valve 64 and a second portion of the conditioned air to the exterior air return 62.

The exterior air return 62 provides a path for exterior air flow to exit the nacelle 40. The exterior air return 62 may assume a variety of different configurations; e.g., an orifice disposed in the exterior surface of the nacelle, or a scoop or other structure that is engaged with the exterior surface of the nacelle 40, or the like.

As indicated above, the second valve 64 is in fluid communication with the first valve 60 via conduit 72B. In addition, the second valve 64 is in fluid communication with the inlet device 56 via conduit 72D. In some embodiments, the second valve 64 may be directly in fluid communication with one or more turbine case clearance control segments 46A in the HPT 34A and/or the LPT 34B; e.g., via conduits 72L, 72M, and 72N. In some embodiments, the second valve 64 may be directly in fluid communication with the third valve 66 (via conduit 72L), and the third valve 66 is in fluid communication with one or more turbine case clearance control segments 46A in the HPT 34A (via conduit 72M) and/or the LPT 34B (via conduit 72N).

The second valve 64 is controllable to be in an open configuration or in a closed configuration. When in the open configuration, the second valve 64 may be controlled to direct exterior air from the inlet device 56 or conditioned air exiting the first valve 60, or some combination thereof, directly to one or more turbine case clearance control segments 46A in the HPT 34A and/or the LPT 34B, or indirectly to the same via the third valve 66 (if the third valve 66 is included).

The term "system controller" as used herein refers to a device that may include any type of computing device, computational circuit, processor(s), CPU, computer, or the like capable of executing a series of instructions that are stored in memory. The instructions may include an operating system, and/or executable software modules such as program files, system data, buffers, drivers, utilities, and the like. The executable instructions may apply to any functionality described herein to enable the turbine ACC system 54 (or a system component) to accomplish the same algorithmically and/or coordination of system components. The system controller 68 may include or may be in communication with one or more memory devices. The present disclosure is not limited to any particular type of memory device, and the memory device may store instructions and/or data in a non-transitory manner. Examples of memory devices that may be used include read-only memory, random access memory, volatile memory, non-volatile memory, static memory, dynamic memory, flash memory, cache memory, and/or any device that stores digital information.

The system controller 68 is shown in FIG. 3 and described herein as an independent component to facilitate the description. The system controller 68 may alternatively be integrated within another controller present with the gas turbine engine 20 (or aircraft) and that controller may be configured to perform the functionality detailed herein. The present disclosure is not limited to any particular controller architecture unless specifically stated herein.

The lubrication system 70 of the gas turbine engine 20 may be configured to cycle a lubricant (e.g., engine oil) from a lubricant storage device (e.g., a lubricant tank—not shown) to the gas turbine engine 20 for lubrication purposes and/or cooling purposes, and back to the storage device. In some embodiments, the lubrication system 70 may also be configured to cycle lubricant to other components; e.g., a gear box, or the like. The type of lubricant may vary depending upon the application; e.g., conventional engine oil, synthetic engine oil, or the like are examples of lubricants that may be used.

During operation of the turbine ACC system 54, exterior air flow extracted from the exterior of the nacelle 40 via the inlet device 56 is directed to the heat exchanger 58 and to the second valve 64. The lubrication system 70 of the gas turbine engine 20 cycles a lubricant through the heat exchanger 58. When the gas turbine is operating, the temperature of the lubricant ($T_L$) will be substantially higher than the temperature of the exterior air flow ($T_{FBA}$; $T_L>T_{FBA}$). Within the heat exchanger 58, thermal energy will be transferred from the lubricant to the exterior air flow. As a result, the temperature of the conditioned air ($T_{CA}$) exiting the heat exchanger 58 will be greater than the temperature of the exterior air ($T_{FBA}$) but less than the temperature of the lubricant ($T_L$); i.e., ($T_{FBA}<T_{CA}<T_L$). The exterior air flow directed to the second valve 64 (via conduit 72D) does not pass through the heat exchanger 58 and therefore arrives at the second valve 64 at a temperature assumed to be the same as the exterior air flow.

The turbine ACC system 54 shown in FIG. 3 may be operated in a "heating mode" or in a "cooling mode". When the turbine ACC system 54 is operating in a cooling mode, the first valve 60 may be controlled to provide all the conditioned air flow to the exterior air return 62; e.g., via conduit 72C. Hence, the elevated temperature conditioned air is diverted away from the turbine case clearance control segments 46A in the HPT 34A and/or the LPT 34B. At the same time, exterior air flow directed to the second valve 64 from the inlet device 56 (via conduit 72D) may be directed through the second valve 64 and to one or more turbine case clearance control segments 46A in the HPT 34A and/or the LPT 34B for cooling purposes; e.g., via conduits 72L, 72M, 72N. The second valve 64 may be controlled to vary the flow of exterior air flow through the second valve 64 and to the turbine case clearance control segments 46A in the HPT 34A and/or the LPT 34B to achieve the desired level of cooling.

In those embodiments that include a third valve 66, the third valve 66 may be controlled to vary the amount of cooling air provided to the turbine case clearance control segments 46A in the HPT 34A and/or the LPT 34B; e.g., 100% of the cooling air is provided to the HPT turbine case clearance control segments 46A, or 75% of the cooling air is provided to the HPT turbine case clearance control segments 46A and 25% of the cooling air is provided to the LPT turbine case clearance control segments 46A, or 50% of the cooling air is provided to the HPT turbine case clearance control segments 46A and 50% of the cooling air is provided to the LPT turbine case clearance control segments 46A, and so on.

When the turbine ACC system 54 is operating in a heating mode, the first valve 60 may be controlled to provide all (or less than all) the elevated temperature conditioned air ($T_C$) received from the heat exchanger 58 (e.g., via conduit 72A) to the second valve 64. If less than all the conditioned air flow received by the first valve 60 is provided to the second valve 64, the remainder of the conditioned air flow may be diverted to the exterior air return 62 (e.g., via conduit 72C) but that is not required. At the same time, exterior air flow is directed to the second valve 64 from the inlet device 56; e.g., via conduit 72D. In a maximum heating mode, the second valve 64 may be controlled to prevent exterior air flow from passing through the second valve 64. As a result, only elevated temperature conditioned air ($T_C$) passes through the second valve 64 and is directed to one or more turbine case clearance control segments 46A in the HPT 34A and/or the LPT 34B to heat the same. In a less than maximum heating mode, the second valve 64 may be controlled to allow exterior air flow ($T_{FBA}$) to pass through the second valve 64 and to allow conditioned air flow ($T_C$) to pass through the second valve 64. The combined exterior air flow and conditioned air flow are directed to one or more turbine case clearance control segments 46A in the HPT 34A and/or the LPT 34B to heat the same. The relative flow contributions of the exterior air flow and conditioned air flow can be varied to achieve the desired level of heating.

In those embodiments that include a third valve 66, the third valve 66 may be controlled to vary the amount of heating air provided to the turbine case clearance control segments 46A in the HPT 34A (e.g., via conduit 72M) and/or the LPT 34B (e.g., via conduit 72N); e.g., 100% of the heating air is provided to the HPT turbine case clearance control segments 46A, or 75% of the heating air is provided to the HPT turbine case clearance control segments 46A and 25% of the heating air is provided to the LPT turbine case clearance control segments 46A, or 50% of the heating air is provided to the HPT turbine case clearance control segments 46A and 50% of the heating air is provided to the LPT turbine case clearance control segments 46A, and so on.

Figure 4:
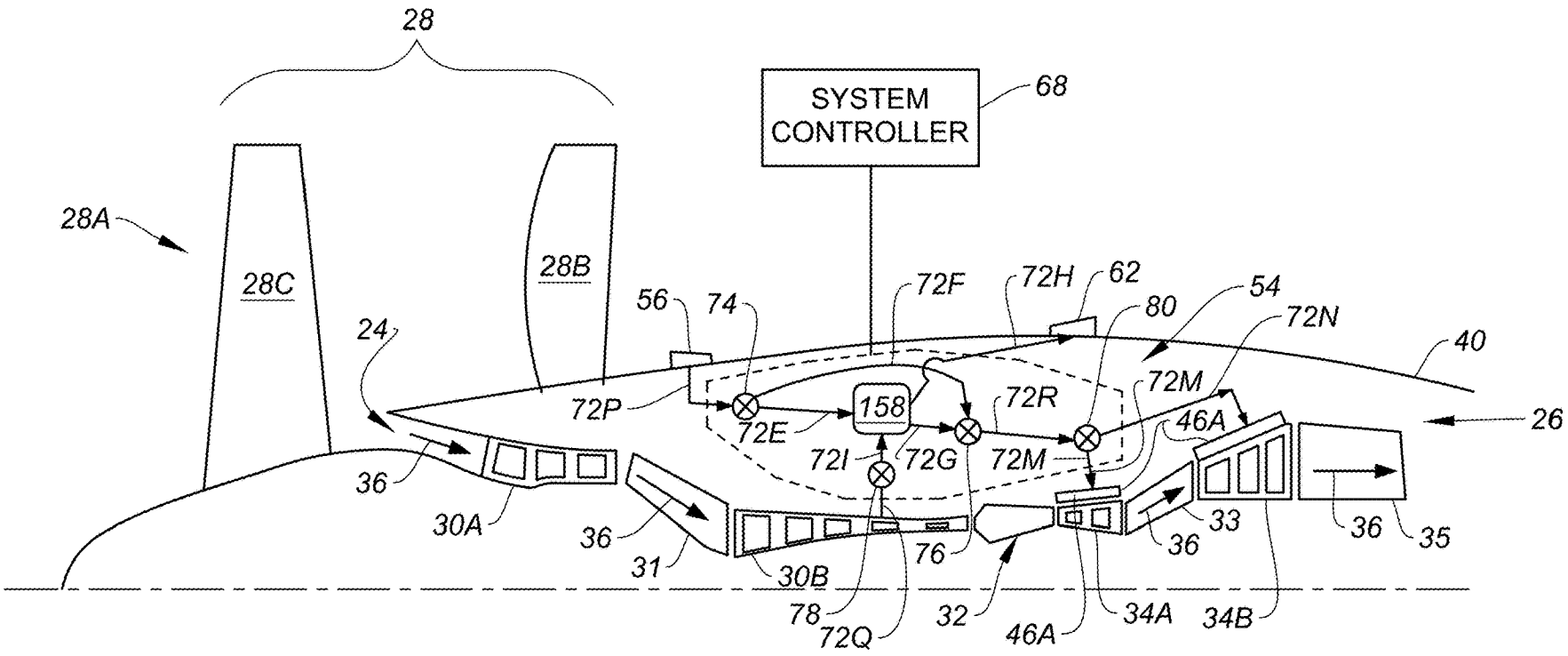
FIG. 4 is a diagrammatic sectional view of a gas turbine engine according to an embodiment of the present disclosure.

FIG. 4 diagrammatically illustrates an embodiment of a turbine active clearance control (ACC) system that may be used in the present disclosure. The turbine ACC system 54 includes an inlet device 56, an initial valve 74, a heat exchanger 158, and a secondary valve 76. In some embodiments (e.g., as shown in FIG. 4), the turbine ACC system 54 may include a compressor bleed valve 78, a turbine segment valve 80, or a system controller 68, or any combination thereof. As will be described herein, air conduits 72E, 72F, 72G, 72H, 72M, 72N, 72P, 72Q, 72R provide fluid communication between the turbine ACC system 54 components. The turbine segment valve 80 may provide the same function as the third valve 66 shown in FIG. 3, but is labeled as a "turbine segment valve 80" in FIG. 4 to distinguish the system embodiments shown in FIGS. 3 and 4.

The inlet device 56 described herein may be used in this turbine ACC system 54 embodiment.

The initial valve 74 is in fluid communication with the inlet device 56 (via conduit 72P), the heat exchanger 158 (via conduit 72E), and the secondary valve 76 (via conduit 72F). The initial valve 74 is controllable to be in an open configuration or in a closed configuration. When in the open configuration, the initial valve 74 may be controlled to direct the exterior air flow to the heat exchanger 158 through a conduit 72E or to the secondary valve 76 through a conduit 72F. The initial valve 74 may be controlled to provide all the exterior air flow to the heat exchanger 158 or all the exterior air flow to the secondary valve 76. In some embodiments, the initial valve 74 may be controlled to provide less than all the conditioned air to the heat exchanger 158 or less than all the exterior air flow to the secondary valve 76; e.g., a partially open configuration. In some embodiments, the initial valve 74 may be configured to provide exterior air flow to both the heat exchanger 158 and the secondary valve 76; i.e., the initial valve 74 may be configured to provide a first portion of the exterior air flow to the heat exchanger 158 and a second portion of the exterior air flow to the secondary valve 76. The relative flow contributions of the exterior air flow to the heat exchanger 158 and to the secondary valve 76 can be varied to achieve the application at hand.

The heat exchanger 158 may be a two-fluid heat exchanger 158 that is configured to receive an exterior air flow extracted from the exterior of the nacelle 40 via the inlet device 56 and configured to receive a compressor bleed air flow from the compressor section 30 of the gas turbine engine 20. The exterior air extracted by the inlet device 56 passes through conduit 72P, the initial valve 74, and conduit 72E before it enters the heat exchanger 158. The heat exchanger 158 is configured to allow thermal energy to transfer from one fluid (i.e., the compressor bleed air) to a second fluid (i.e., exterior air flow). The heat exchanger 158 is not limited to any particular configuration other than the two fluids are maintained separate from one another within the heat exchanger 158; i.e., no direct contact or mixing between the fluids. A crossflow heat exchanger is a non-limiting example of an acceptable configuration for the heat exchanger 158. The exterior air flow exiting the heat exchanger 158 (referred to hereinafter as "conditioned air") is directed to the secondary valve 76 through a conduit 72G. As diagrammatically shown in FIG. 4, the compressor bleed air exiting the heat exchanger 158 may be exhausted to the bypass air flow path via a conduit 72H in communication with the exterior air return 62. The present disclosure is not limited to exhausting compressor bleed air in this manner. The exterior air return 62 may be configured as described herein.

Core gas flow worked within the compressor section 30 increases in pressure as it passes through each sequential compressor rotor stage. The present disclosure contemplates that the specific position at which a compressor air bleed flow is extracted from the compressor section 30 (e.g., which compressor rotor stage) may be chosen based on the magnitude of the compressor air pressure available at that specific position, as well as other factors. FIG. 4 illustrates compressor bleed air extracted from the HPC 30B via a conduit 72Q. The extracted compressor bleed may pass through a compressor bleed valve 78 and through conduit 72I before entering the heat exchanger 158. In some embodiments, compressor bleed air extracted from the LPC 30A may be adequate for use in the present disclosure turbine ACC system 54. The present disclosure is not limited to extracting compressor bleed air from the HPC 30B or the LPC 30A, or any rotor stage in either.

As indicated above, in the system embodiment shown in FIG. 4 the secondary valve 76 is in fluid communication with the initial valve 74; e.g., via conduit 72F. In addition, the secondary valve 76 is in fluid communication with the heat exchanger 158; e.g., via conduit 72G. In some embodiments, the secondary valve 76 may be directly in fluid communication with one or more turbine case clearance control segments 46A in the HPT 34A (e.g., via conduits 72R and 72M) and/or the LPT 34B (e.g., via conduit 72N). In some embodiments, the secondary valve 76 may be directly in fluid communication with the turbine segment valve 80 (e.g., via conduit 72R), and the turbine segment valve 80 is in fluid communication with one or more turbine case clearance control segments 46A in the HPT 34A (e.g., via conduit 72M) and/or the LPT 34B (e.g., via conduit 72N).

The secondary valve 76 is controllable to be in an open configuration or in a closed configuration. When in the open configuration, the secondary valve 76 may be controlled to direct conditioned air from the heat exchanger 158 or exterior air flow from the initial valve 74, or some combination thereof, directly to one or more turbine case clearance control segments 46A in the HPT 34A and/or the LPT 34B, or indirectly to the same via the turbine segment valve 80 (if a turbine segment valve 80 is included).

In those embodiments that include a turbine segment valve 80, the turbine segment valve 80 may be controlled to vary the amount of cooling air provided to the turbine case clearance control segments 46A in the HPT 34A and/or the LPT 34B in the manner described herein.

As stated above, air conduits 72A-72R (as shown in FIGS. 3 and 4) are intended to be diagrammatic representations of air passages formed by interior structural panels, or tubes, or the like, or any combination thereof that provide fluid communication between the turbine ACC system 54 components. The present disclosure is not limited to any particular conduit configuration.

The turbine ACC system 54 embodiment shown in FIG. 4 may be operated in a "heating mode" or in a "cooling mode". During operation of the turbine ACC system 54, exterior air flow extracted from the exterior of the nacelle 40 via the inlet device 56 is selectively directed to the initial valve 74 and/or to the heat exchanger 158.

In the heating mode, compressor bleed air flow is directed into the heat exchanger 158. The temperature ($T_{CBA}$) of the compressor bleed air flow is substantially higher than the temperature ($T_{FBA}$) of the exterior air flow passing through the heat exchanger 158. Within the heat exchanger 158, thermal energy will be transferred from the compressor bleed air flow to the exterior air flow. As a result, the temperature of the conditioned air ($T_{CA}$) exiting the heat exchanger 158 will be greater than the temperature of the exterior air ($T_{FBA}$) but less than the temperature of the compressor bleed air flow ($T_{CBA}$); i.e., ($T_{FBA}<T_{CA}<T_{CBA}$).

When the turbine ACC system 54 is operating in a maximum heating mode, the initial valve 74 may be controlled to provide exterior air flow solely to the heat exchanger 158 and not directly to the secondary valve 76. In this mode, only conditioned air is passed to the secondary valve 76 (i.e., no exterior air flow is provided to the secondary valve 76) and the secondary valve 76 is controlled to pass the conditioned air flow to one or more turbine case clearance control segments 46A in the HPT 34A and/or the LPT 34B to heat the same.

When the turbine ACC system 54 is operating in a less than maximum heating mode, the initial valve 74 may be controlled to provide a portion of the exterior air flow to the heat exchanger 158 and a portion of the exterior air flow to the secondary valve 76 to control the temperature of the air that can be passed out from the secondary valve 76. To be clear, the exterior air flow directed to the secondary valve 76 from the initial valve 74 does not pass through the heat exchanger 158 and therefore arrives at the secondary valve 76 at a temperature assumed to be the same as the exterior air flow. The combined exterior air flow and conditioned air flow (referred to hereinafter as "combined air flow") pass through the secondary valve 76 and are directed to one or more turbine case clearance control segments 46A in the HPT 34A and/or the LPT 34B to heat the same. The relative flow contributions of the exterior air flow and conditioned air flow within the combined air flow can be varied to achieve the desired level of heating.

In those embodiments that include a turbine segment valve 80, the turbine segment valve 80 may be controlled to vary the amount of heating air (i.e., conditioned air flow or combined air flow) provided to the turbine case clearance control segments 46A in the HPT 34A and/or the LPT 34B as described herein.

When the turbine ACC system 54 is operating in a cooling mode, the secondary valve 76 may be controlled to provide all or a portion of the exterior air flow (from the initial valve 74) to the turbine case clearance control segments 46A in the HPT 34A and/or the LPT 34B and none of the conditioned air flow from the heat exchanger 158. To moderate the level of cooling, the secondary valve 76 may be controlled to provide some amount of conditioned air for combination with the exterior air for delivery to the turbine case clearance control segments 46A in the HPT 34A and/or the LPT 34B; i.e., this is "combined air flow" as described above, except that in the cooling mode the combined air flow is predominated by exterior air flow to enable it to act as a cooling medium.

In those embodiments that include a turbine segment valve 80, the turbine segment valve 80 may be controlled to vary the amount of cooling air provided to the turbine case clearance control segments 46A in the HPT 34A and/or the LPT 34B as described above.

During certain operational segments of the gas turbine engine 20, the rotor stages 44 (see FIG. 2) in a turbine section 34 may "radially grow" resulting in the rotor blade tips 52 being disposed further outward in a radial direction than they were previously. The "radial growth" may be caused by centrifugal forces acting on the rotor stage 44 when it transitions from a first rotational velocity (RV1) to a higher second rotational (RV2; RV2>RV1) and/or may be caused by a temporary thermal disparity between the rotor stage 44 and the turbine case clearance control segment 46A disposed radially outside of the rotor stage 44. The thermal disparity may occur during a transient phase when the power is substantially increased in the gas turbine engine 20 (e.g., from a taxiing state to a take-off state). The relatively fast increase in core gas temperature causes portions of the rotor stage 44 to thermally expand at a faster rate than the respective turbine case clearance control segment 46A. Engine efficiency is affected by blade tip 52 clearance and therefore maintaining a minimum blade tip clearance is desirable for efficiency. However, if a "pinch" event occurs between the blade tips 52 and the blade outer air seal 46C of the turbine case clearance control segment 46A, undesirable blade tip 52 and/or blade outer air seal 46C wear can occur.

During a gas turbine engine 20 operational segment wherein there is likely to be a thermal disparity between the rotor stage 44 and the turbine case clearance control segment 46A radially outside of the rotor stage 44 the present disclosure turbine ACC system 54 is configured to provide an elevated temperature air flow (which may be conditioned air flow or combined air flow) to the turbine case clearance control segment(s) 46A to mitigate the thermal disparity between the rotor stage 44 and the turbine case clearance control segment 46A; i.e., the turbine case heating mode. Exposing the turbine case clearance control segment 46A to the elevated temperature air flow will cause the turbine case clearance control segment 46A to heat up and thermally grow faster than it would otherwise, and thereby mitigate the potential for a pinch event. The present disclosure turbine ACC system 54 provides a significant improvement to active blade tip clearance control that can be implemented during numerous gas turbine engine operational segments.

A benefit of the present disclosure turbine ACC system 54 is that the temperature of the air flow provided to the turbine case clearance control segment(s) 46A can be controlled in real time in response to changing engine operating conditions. For example, during an initial transient phase when there is a considerable thermal disparity between the rotor stage 44 and the turbine case clearance control segment 46A radially outside of the rotor stage 44, the present disclosure turbine ACC system 54 can be controlled to provide an elevated temperature air flow to the turbine case clearance control segment 46A. As the thermal disparity between the rotor stage 44 and the turbine case clearance control segment 46A decreases, the present disclosure turbine ACC system 54 can be controlled to decrease the temperature of the air flow to the turbine case clearance control segment 46A in real time. The controlled temperature of the air flow to the turbine case clearance control segment 46A may be selected to create a blade tip gap that is large enough to avoid a pinch condition, and also small enough to decrease leakage at the blade tip 52 and thereby improve engine efficiency.

In some gas turbine engine 20 operational segments (e.g., cruise state at an elevated altitude) wherein the temperatures of the rotor stage 44 and the turbine case clearance control segment 46A are no longer in a transient mode, it may be beneficial to cool the turbine case clearance control segment 46A. In these instances, the turbine ACC system 54 may be controlled to provide exterior air flow (or combined air flow) to the turbine case clearance control segment(s) 46A and thereby increase the useable life of the turbine case clearance control segment 46A components. Moreover, since environmental conditions (e.g., temperature) may vary considerable based on region climate, time of year, altitude, and the like, it may be beneficial to use varying mixtures of exterior air flow and conditioned air to achieve an air temperature that is optimal for cooling the turbine case clearance control segment(s) 46A; i.e., to arrive at a desirable blade tip clearance without creating a pinch scenario.

Figure 5:
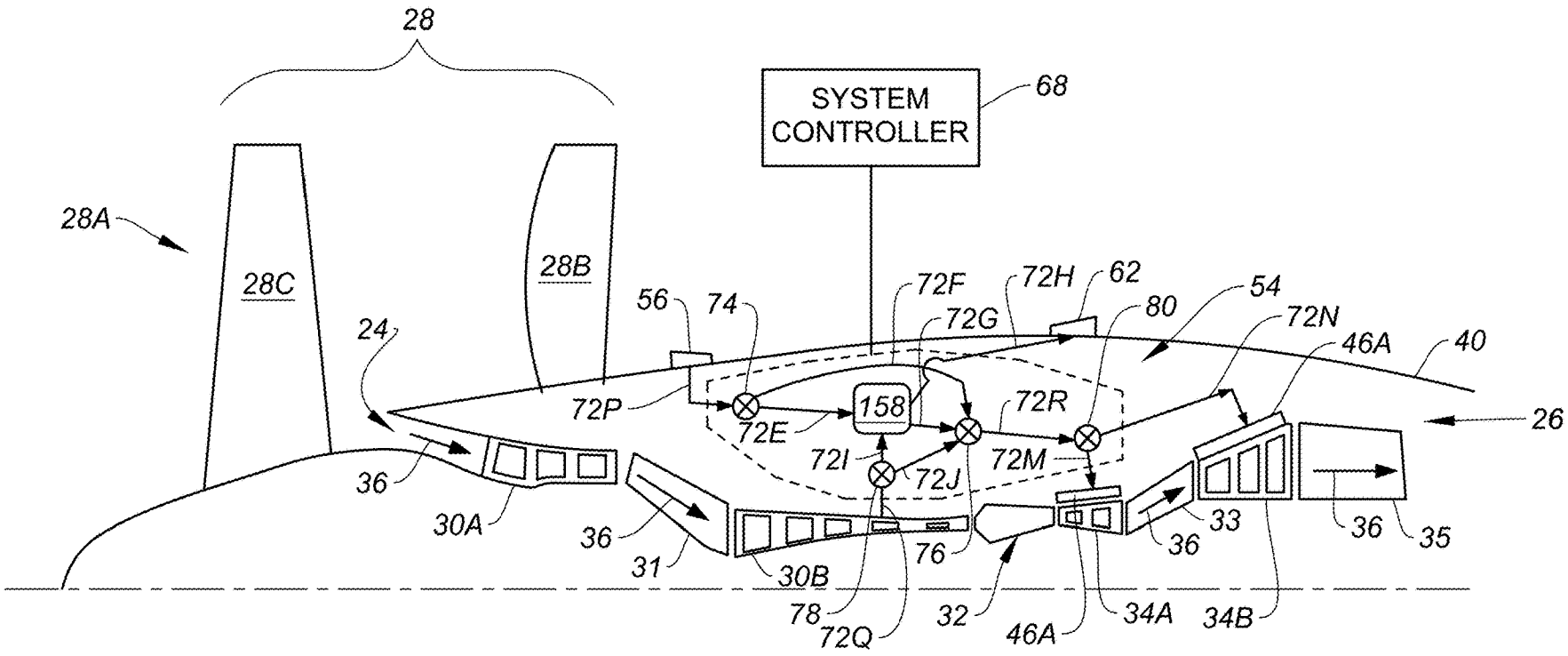
FIG. 5 is a diagrammatic sectional view of a gas turbine engine according to an embodiment of the present disclosure.

FIG. 5 diagrammatically illustrates an embodiment of a turbine ACC system 54 shown in FIG. 4, except in this embodiment, the secondary valve 76 may be configured to receive and control a compressor bleed flow directly from the compressor section 30; i.e., compressor bleed flow that has not passed through the heat exchanger 158. FIG. 5 illustrates a conduit 72J extending between the compressor bleed valve 78 and the secondary valve 76. The present disclosure is not limited to this configuration. A direct flow of compressor bleed air may be used to provide higher temperature air flow (also may be at a higher pressure) to the turbine case clearance control segment(s) 46A as may be useful when the turbine ACC system 54 is operating in a heating mode.

The present disclosure system enables dual mode operation such that turbine case heating and turbine case cooling may be achieved. Turbine case heating may be performed during engine warm-up and prior to takeoff acceleration. Turbine case cooling may be performed while the aircraft is in cruise mode. The heating and cooling modes of operation allow for actively controlled turbine tip clearances, by managing circumferentially averaged case metal temperatures to control bulk case thermal growth. Management of the turbine case temperature at ground idle and prior to the takeoff acceleration may reduce or eliminate the acceleration clearance pinch by heating (thermally growing) the turbine case prior to rapid growth of the rotor system during an engine acceleration. The reduction in the acceleration clearance pinch allows for reduction in nominal (cold) build clearances which may be realized as a cycle efficiency benefit, leading to reduced fuel burn.

While the principles of the disclosure have been described above in connection with specific apparatuses and methods, it is to be clearly understood that this description is made only by way of example and not as limitation on the scope of the disclosure. Specific details are given in the above description to provide a thorough understanding of the embodiments. However, it is understood that the embodiments may be practiced without these specific details.

It is noted that the embodiments may be described as a process which is depicted as a flowchart, a flow diagram, a block diagram, etc. Although any one of these structures may describe the operations as a sequential process, many of the operations can be performed in parallel or concurrently. In addition, the order of the operations may be rearranged. A process may correspond to a method, a function, a procedure, a subroutine, a subprogram, etc.

The singular forms "a," "an," and "the" refer to one or more than one, unless the context clearly dictates otherwise. For example, the term "comprising a specimen" includes single or plural specimens and is considered equivalent to the phrase "comprising at least one specimen." The term "or" refers to a single element of stated alternative elements or a combination of two or more elements unless the context clearly indicates otherwise. As used herein, "comprises" means "includes." Thus, "comprising A or B," means "including A or B, or A and B," without excluding additional elements.

It is noted that various connections are set forth between elements in the present description and drawings (the contents of which are included in this disclosure by way of reference). It is noted that these connections are general and, unless specified otherwise, may be direct or indirect and that this specification is not intended to be limiting in this respect. Any reference to attached, fixed, connected or the like may include permanent, removable, temporary, partial, full and/or any other possible attachment option.

No element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprise", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

While various inventive aspects, concepts and features of the disclosures may be described and illustrated herein as embodied in combination in the exemplary embodiments, these various aspects, concepts, and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts, and features of the disclosures—such as alternative materials, structures, configurations, methods, devices, and components, and so on—may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the present application even if such embodiments are not expressly disclosed herein. For example, in the exemplary embodiments described above within the Detailed Description portion of the present specification, elements may be described as individual units and shown as independent of one another to facilitate the description. In alternative embodiments, such elements may be configured as combined elements. It is further noted that various method or process steps for embodiments of the present disclosure are described herein. The description may present method and/or process steps as a particular sequence. However, to the extent that the method or process does not rely on the particular order of steps set forth herein, the method or process should not be limited to the particular sequence of steps described. As one of ordinary skill in the art would appreciate, other sequences of steps may be possible.

The invention claimed is:

1. A gas turbine engine, comprising:

an open rotor propulsion system;

a compressor section;

a combustion section;

a turbine section having a rotor stage and a turbine case clearance control segment disposed radially outside of the rotor stage;

a turbine active clearance control system that includes a first valve, a heat exchanger, a second valve, and an air inlet device in fluid communication with an exterior wall of a nacelle;

wherein the first valve is in fluid communication with the air inlet device to an exterior air flow from the air inlet device, the first valve disposed upstream of and in fluid communication with the heat exchanger and the second valve, and the first valve is configured to provide the exterior air flow to the heat exchanger, or to the second valve, or to both;

wherein the heat exchanger is configured to permit heat transfer within the heat exchanger between the exterior air flow provided to the heat exchanger and a compressor bleed flow from the compressor section provided to the heat exchanger to produce a flow of conditioned air;

wherein the second valve is configured to receive the exterior air flow from the first valve and to receive the flow of conditioned air from the heat exchanger;

wherein the turbine active clearance control system is configured to operate in a heating mode, and in the heating mode the second valve is configured to provide the flow of conditioned air, or a combined air flow that includes the flow of conditioned air and the exterior air flow, to the turbine case clearance control segment; and wherein the second valve is in fluid communication with a turbine segment valve, and the turbine segment valve is configured to vary the flow of conditioned air, the exterior air flow, or both provided to the turbine case clearance control segment.

2. The gas turbine engine of claim 1, wherein in the heating mode the first valve is controllable to selectively vary relative amounts of the exterior air flow provided to the heat exchanger and the exterior air flow provided to the second valve.

3. The gas turbine engine of claim 1, wherein in the heating mode the second valve is controllable to selectively vary relative amounts of the flow of conditioned air and the exterior air flow provided to the turbine case clearance control segment.

4. The gas turbine engine of claim 1, wherein the turbine section includes a high pressure turbine section and the turbine case clearance control segment includes a first turbine case clearance control segment disposed radially outside of a high pressure rotor stage within the high pressure turbine section.

5. The gas turbine engine of claim 4, wherein the turbine section includes a low pressure turbine section and the turbine case clearance control segment includes a second turbine case clearance control segment disposed radially outside of a low pressure rotor stage within the low pressure turbine section.

6. The gas turbine engine of claim 1, wherein the turbine active clearance control system is configured to operate in a cooling mode, and in the cooling mode the first valve is configured to provide at least a portion of the exterior air flow to the second valve.

7. The gas turbine engine of claim 6, wherein in the cooling mode the second valve is configured to provide at least a portion of the exterior air flow to the turbine case clearance control segment.

8. A method of actively controlling rotor tip clearance in a gas turbine engine disposed in a nacelle, the gas turbine engine including an open rotor propulsion system, a compressor section, a combustion section, a turbine section having a rotor stage, and a turbine case clearance control segment disposed radially outside of the rotor stage, the method comprising:

providing a turbine active clearance control system that includes a first valve, a heat exchanger, and a second valve, wherein the first valve is disposed upstream of and in fluid communication with the heat exchanger and the second valve;

using the first valve to receive an exterior air flow extracted from an exterior of the nacelle, and to provide the exterior air flow to a heat exchanger, or to the second valve, or to both;

wherein the heat exchanger is configured to permit heat transfer within the heat exchanger between the exterior air flow provided to the heat exchanger and a compressor bleed flow extracted from the compressor section and provided to the heat exchanger to produce a flow of conditioned air;

using the second valve to receive the exterior air flow from the first valve and to receive the flow of conditioned air from the heat exchanger; and operating the turbine active clearance control system in a heating mode or in a cooling mode, wherein the heating mode includes controlling the second valve to provide the flow of conditioned air, or a combined air flow that includes the flow of conditioned air and the exterior air flow from the first valve, to the turbine case clearance control segment, the turbine active clearance control system including a turbine segment valve, the turbine segment valve configured to vary the flow of conditioned air, the combined air flow or the exterior air flow provided to the turbine case clearance control segment.

9. The method of claim 8, wherein in the heating mode the method includes controlling the first valve to vary relative amounts of the exterior air flow provided to the heat exchanger and the exterior air flow provided to the second valve.

10. The method of claim 8, wherein in the heating mode the method includes controlling the second valve to vary relative amounts of the flow of conditioned air and the exterior air flow from the first valve provided to the turbine case clearance control segment.

11. The method of claim 8, wherein in the cooling mode the method includes controlling the first valve to vary relative amounts of the exterior air flow provided to the heat exchanger and the exterior air flow provided to the second valve; and controlling the second valve to vary relative amounts of the flow of conditioned air and the exterior air flow from the first valve provided to the turbine case clearance control segment.

12. The gas turbine engine of claim 1, wherein the turbine active clearance control system further includes a compressor bleed valve; and the heat exchanger is in fluid communication with the compressor bleed valve.

13. The gas turbine engine of claim 1, wherein the exterior wall of the nacelle is an outermost radial surface of the gas turbine engine.

14. The gas turbine engine of claim 1, wherein the open rotor propulsion system includes a rotor and a stator vane;

the stator vane is disposed on the exterior of the nacelle; and the stator vane is arranged between the rotor and the air inlet device.

15. The gas turbine engine of claim 1, wherein the air inlet device includes a scoop.

* * * * *